United States Patent [19]

Hulme et al.

[11] Patent Number: 4,519,478

[45] Date of Patent: May 28, 1985

[54] LADDER EXTENSION COUPLING

[75] Inventors: James H. Hulme, Milton; Stuart E. Shinn, Scarborough, both of Canada

[73] Assignee: Supreme Aluminum Industries Limited, Scarborough, Canada

[21] Appl. No.: 611,206

[22] Filed: May 17, 1984

[51] Int. Cl.[3] ..... E06C 1/10; E06C 1/28

[52] U.S. Cl. ..... 182/178; 182/207; 182/22

[58] Field of Search ..... 182/178, 207, 209, 22, 182/121, 23

[56] References Cited

U.S. PATENT DOCUMENTS

| | | | |
|---|---|---|---|
| 66,655 | 7/1867 | Turner | 182/178 |
| 329,922 | 11/1885 | Lyon | 182/178 |
| 461,521 | 10/1891 | Lovejoy | 182/178 |
| 511,849 | 1/1894 | Lang | 182/178 |
| 700,690 | 5/1902 | Hogan | 182/178 |
| 1,520,414 | 12/1924 | Hamilton | 182/178 |
| 1,555,344 | 9/1925 | Whitney | 182/22 |
| 1,935,349 | 11/1933 | Breslow | 182/178 |
| 2,257,863 | 10/1941 | Schwarz | 182/178 |
| 2,887,260 | 5/1959 | McKinnie | 182/178 |
| 3,067,836 | 12/1962 | Carnicelli | 182/121 |
| 4,226,302 | 10/1980 | Roche | 182/178 |

FOREIGN PATENT DOCUMENTS

| | | | |
|---|---|---|---|
| 1252593 | 12/1960 | France | 182/178 |

*Primary Examiner*—Reinaldo P. Machado
*Attorney, Agent, or Firm*—R. Brant Latham

[57] ABSTRACT

A ladder extension is disclosed comprising two separable sections to be coupled together in longitudinally overlapping relation by first coupling means coupling a portion of a first ladder section proximate one end thereof to the second section so as to permit the first ladder section to be rotated with respect to the second ladder section to a position where second coupling means are aligned in position for engagement, preferably with stop means being provided to stop rotation of the first ladder section at a position where the second coupling means are aligned for engagement. The ladder comprises two separable sections which is easy to asemble by a single person even under adverse field conditions and which provides means to positively lock together the sections when assembled into an extension ladder.

30 Claims, 11 Drawing Figures

LADDER EXTENSION COUPLING

FIELD OF THE INVENTION

This invention relates generally to extension ladders and more particularly to extension ladders comprising two separable sections which may readily be coupled together to constitute an extension ladder.

BACKGROUND OF THE INVENTION

In the past various extension ladders comprising separable sections have been provided. Typical are the ladders disclosed in U.S. Pat. No. 1,555,344 to Whitney issued Sept. 29, 1925; Australian Pat. No. 289,370 to Paynter of Mar. 4, 1969 and French Pat. No. 1,252,593 to Roth issued Dec. 19, 1960. In each of these patents the ladders comprise separable base and extension sections which are coupled together at longitudinally spaced locations by means of co-operating rung and slot couplings whereby rungs and extensions of rungs are received in longitudinally extending slots.

These prior art extension ladders all suffer a major disadvantage that to couple the two separable sections of the ladder together requires the two sections to be precisely positioned with respect to each other in longitudinal alignment so that the slot and rung coupling means at the two spaced locations may be concurrently engaged. Suitable positioning of the ladder sections may be extremely difficult particularly by a single person when the ladder sections are heavy or when no suitably flat terrain is available on which to lay both of the ladder sections. When used outdoors, vegetation, mud and snow may catch on the sections or partially block the slots increasing the difficulty of coupling the sections together. Further in frigid wintery conditions protective clothing such as mitts and gloves impair the ability of an individual to precisely locate the ladder sections as is required for coupling.

Servicemen working for utility companies such as hydro electric suppliers, cable television suppliers and telephone companies require ladders for day-to-day use. For example in Canada, telephone company servicemen require almost daily a ladder which can extend to 17 feet. Less frequently they will require a ladder which extends to 21 feet. In the past these servicemen have been provided with a two piece telescoping extension ladder which is 12 feet in length when unextended and may extend to 21 feet. Recently, however, telephone servicemen have been provided with several automobiles of smaller size than previously, with the result that the existing 12 foot ladders are longer than the new automobiles and present a safety hazzard. To overcome this problem new ladders were proposed comprising a telescoping two piece ladder of 10 foot length unextended which may extend to 17 feet. To provide the ladder with the capability to extend 21 feet when necessary a third detachable section has been proposed. The disadvantages of the prior art extension ladders have made the use of known separable extensions unsatisfactory particularly in regard to difficulties in coupling the separable section to the rest of the ladder by a single serviceman in the field. Another disadvantage of the known separable extension ladder is the absence of any provision for positive locking of the separable extension to the rest of the ladder as is required to ensure safe use of the ladder.

SUMMARY OF THE INVENTION

Accordingly, it is an object of the present invention to at least partially overcome these disadvantages of the prior art by providing a ladder comprising two separable sections to be coupled together in longitudinally overlapping relation by first coupling means coupling a portion of a first ladder section proximate one end thereof to the second section so as to permit the first ladder section to be rotated with respect to the second ladder section to a position where second coupling means are aligned in position for engagement, preferably with stop means being provided to stop rotation of the first ladder section at a position where the second coupling means are aligned for engagement.

Another object is to provide a ladder comprising two separable sections which is easy to assemble by a single person even under adverse field conditions.

Another object is to provide a ladder comprising two separable sections which provides means to positively lock together the sections when assembled into an extension ladder.

To this end, in one of its aspects the present invention provides a ladder comprising two separable sections, a ladder extension section and a base ladder section to be coupled together in longitudinally overlapping relation to constitute an extension ladder;

each section comprising rails and rungs, portions of each rail of the extension section at the lower end thereof being spaced to be received between rails of the ladder section and having complementary primary slots formed therethrough to slidably receive one rung of the base section therein;

each primary slot having a blind end proximate the lower end of the extension section, the primary slots extending from the blind end longitudinally away from the lower end of the extension section to an open end permitting entrance of the one rung therein; wherein with the one rung received in the primary slots at the blind ends, the extension section being rotatable with respect to the ladder section about the one rung;

first coupling means on the extension section spaced longitudinally from the slot on the remote side of the slot from the lower end of the extension section;

secondly coupling means on the ladder section spaced longitudinally from the one rung on the remote side of the one rung from the lower end of the ladder section;

stop means on one of the extension section and ladder section, wherein with the one rung received in the slots at the blind ends, on rotation of the extension section about the one rung, the stop means stopping rotation of the extension section about the one rung at a position wherein the first and second coupling means are in alignment for coupling, the first and second coupling means engaging to couple together by sliding the extension section from the position in a substantially longitudinal direction with respect to the ladder section to slide the one rung in the primary slots away from the blind ends, the primary slots being of sufficient longitudinal extension that with the first and second coupling means coupled together the one rung being retained within the primary slot;

the first and second coupling means on coupling preventing further sliding of the extension section in the direction, and, with the first and second coupling means coupled together and the one rung retained within the primary slots, relative rotation of the extension section with respect to the longitudinal section is prevented.

In another of its aspects, the present invention provides a ladder comprising two separable sections, a first section and a second section to be coupled together in longitudinally overlapping relation to constitute an extension ladder with a first end of each section overlapping with the other section and the other, second, end of each section to be remote from the respective other section, each section comprising rails and rungs, the first end of the first section coupling to the second section by means of complementary primary slots in the rails of one of the first and second sections to slidably receive one rung of the other of the first and second sections;

the primary slot having a blind end and extending longitudinally away from the blind slot directionally away from the first end of the first or second section provided with the primary slot to an open end permitting entrance of the one rung therein; wherein with the one rung received in the primary slots at the blind ends, the first section being rotatable with respect to said second section about said one rung first coupling means on the first section spaced longitudinally from the one of the primary slots and the one rung provided on the first section on the remote side thereof from said first end of the first section;

second coupling means on the second section spaced longitudinally from the one of the primary slots and the one rung provided on the second section on the remote side thereof from the second end of the second section, stop means on one of the first section and second section, wherein with said one rung received in the primary slots at the blind ends, on rotation of the first section about the one rung, the stop means stopping rotation of the first section about the one rung at a position wherein the first and second coupling means are in alignment for coupling, the first and second coupling means engaging to couple together by sliding the first section from the position in a substantially longitudinal direction with respect to the second section to slide the one rung in the primary slots away from the blind ends, said primary slots being of sufficient longitudinal extension that with the first and second coupling means coupled together the one rung being retained within the primary slot;

the first and second coupling means on coupling preventing further sliding of the first section in the direction, and with the first and second coupling means coupled together and the one rung retained within the primary slots relative rotation of the first section with respect to the second section being prevented.

BRIEF DESCRIPTION OF THE DRAWINGS

Further objects and advantages of the invention will appear from the following description taken together with the accompanying drawings in which.

DESCRIPTION OF THE PREFERRED EMBODIMENTS

Figure 1:
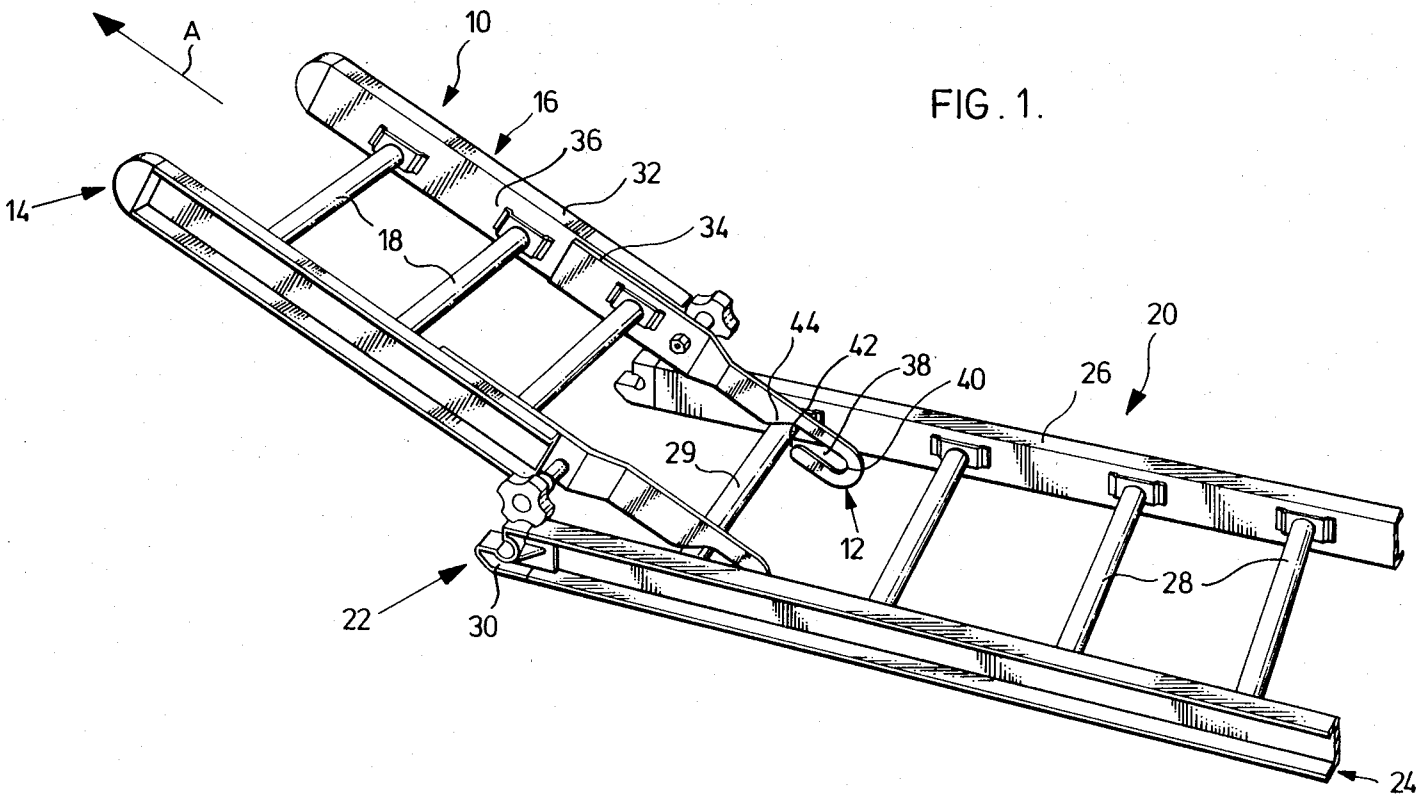
FIG. 1 is a pictorial view of an extension ladder in accordance with a first embodiment of the invention shown with two separable ladder sections located relative to each other in a first position to initiate a coupling sequence.
Figure 4:
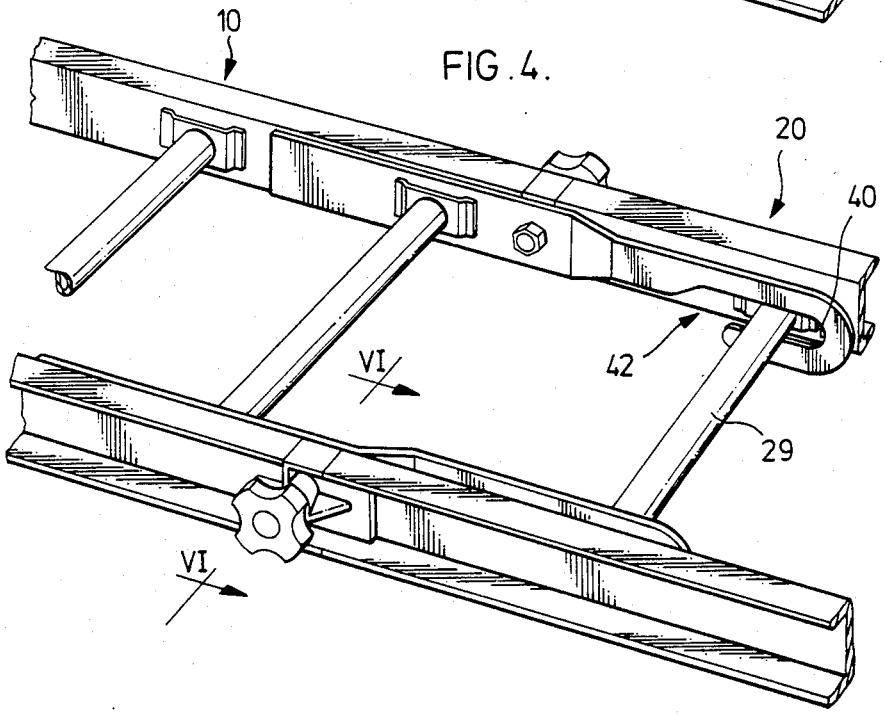
FIG. 4 is a partial pictorial view of the ladder of FIG. 1 with the two separable ladder section located relative to each other in a fourth coupled position.

Reference is made first to FIG. 1 showing a first preferred embodiment in accordance with the present invention. The extension ladder comprises two seperable ladder sections, a first or extension section 10 and a second or base section 20. Each of the first and second ladder sections have a first end 12 and 22, respectively, and a second end 14 and 24, respectively. The first ends are designated so that as shown in FIG. 4 when the two sections are coupled together to comprise an extension ladder, the first end of each section is the end overlapping with the other section whereas the second end of each section is the end shown to be remote from the respective other section.

Each ladder section comprises rails and rungs with the rails of the first and second sections designated 16 and 26, respectively. The rungs of the first section 10 are designated 18 while the rungs of the second section are generally designated 28 with the exception of the one rung closest to the first end 22 of the second section 20 which is designated 29.

Rails 26 of the second section 20 are shown as parallel, cross-sectionally U-shaped members with an end cap 30 at the first end 22 to be described later. The rails 16 of the first section 10 are shown to comprise two rails portions, 32 and 34, with rail portions 32 closest to the second end 14 of the first section 10 being parallel cross-sectionally U-shaped members similar to rails 26. Rail portions 34 proximate the first end 12 of the first section 10 comprise a pair of hook-like members fixedly secured as, for example, by rivetting to inside surfaces 36 of rail portions 32 and extend longitudinally beyond the ends of rail portions 32.

Rails 26 of the second section are provided spaced the same distance as rail portions 32 of rail 16 of the first section. Rail portions 34 of the first section are spaced so as to be received between rails 26 of the second section.

Figure 3:
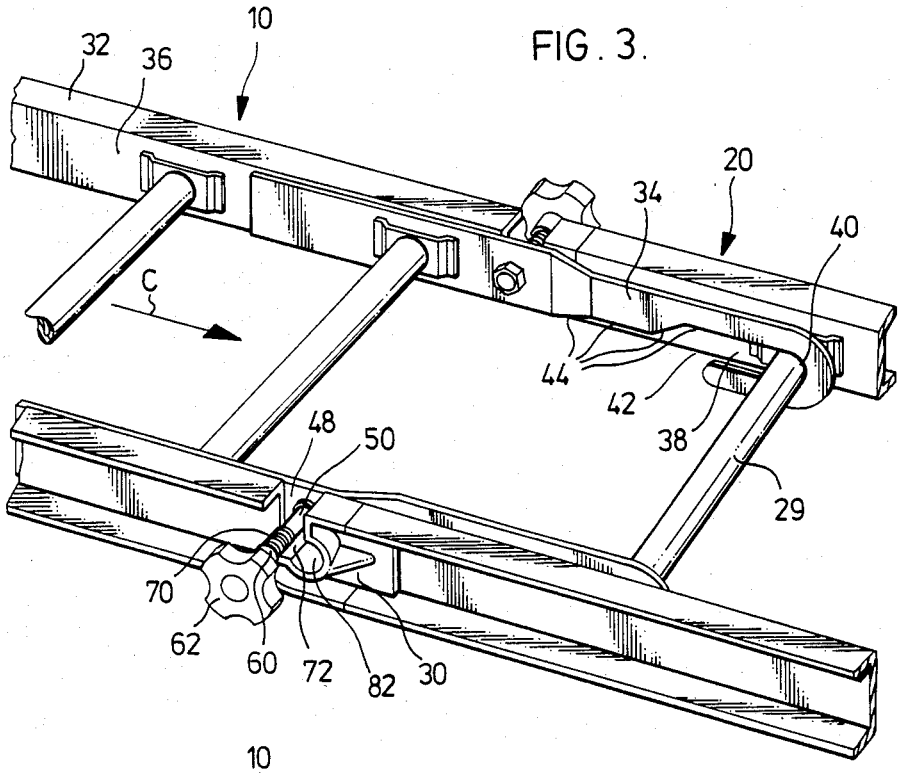

Each rail portion 34 appears as a hook-like member by reason of primary slots 38 transversely therethrough in the direction of extension of rungs 18. Primary slot 38 extends from a blind end 40 longitudinally with respect to rails 16 away from first end 12 of the first section 10 to a slot opening 42. As best seen in FIG. 3, surfaces 44 of rail portion 34 bordering these slot openings 42 are suitably shaped to assist in guiding rung 29 of the second section 20 into primary slot 38 as is described later.

Primary slot 38 is sized so as to closely receive rung 29 yet to permit rung 29 to enter slot opening 42 and to be slidable longitudinally in the slot to contact and engage blind end 40.

Figure 5:
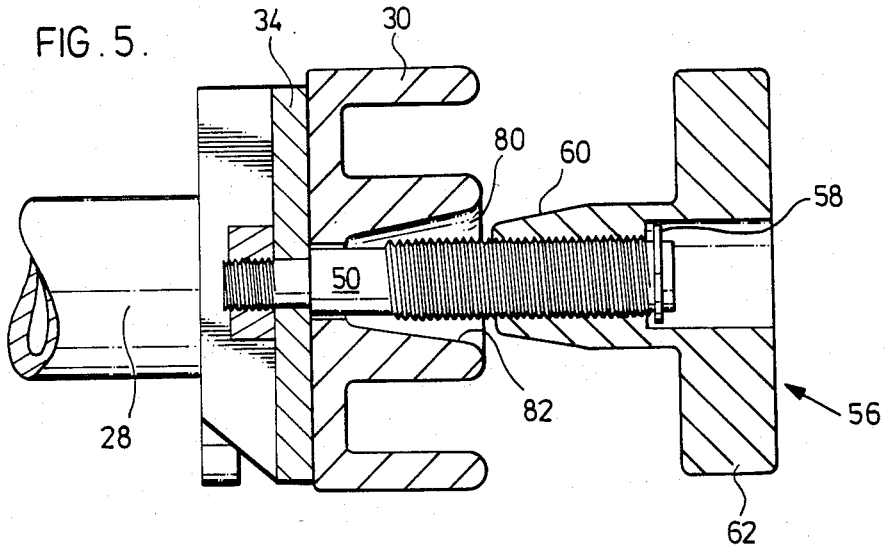
FIGS. 5 and 6 are similar cross-sectional views through section line V—V' of FIG. 4 showing a locking means in an unlocked and locked position, respectively.
Figure 6:
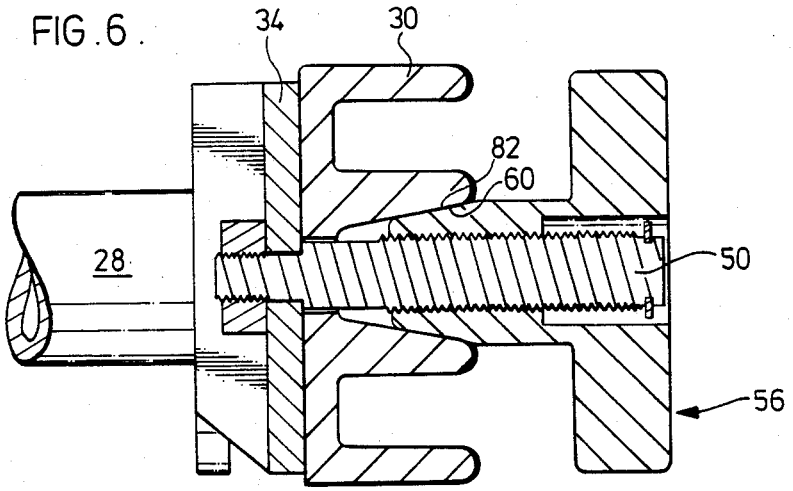
Figure 7:
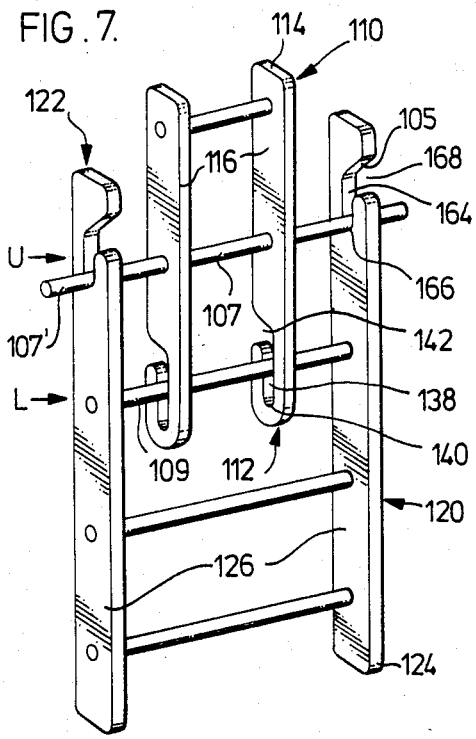
FIG. 7 shows a schematic pictorial view of two ladder sections coupled to from an extension ladder in accordance with a second embodiment of the invention similar in many respects to the ladder shown in FIG. 1.
Figure 8:
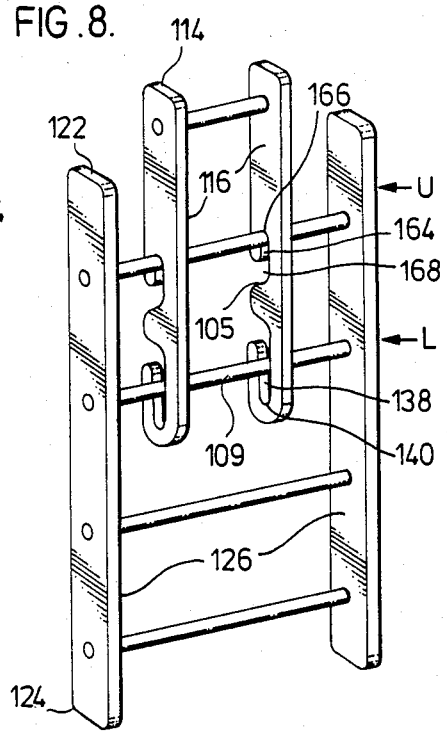
FIGS. 8, 9 and 10 show schematic pictorial views of two ladder sections coupled to form extension ladders in accordance with third, fourth and fifth embodiments of the invention.
Figure 9:
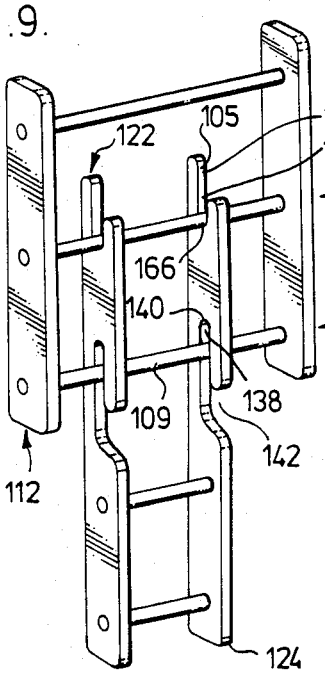
Figure 10:
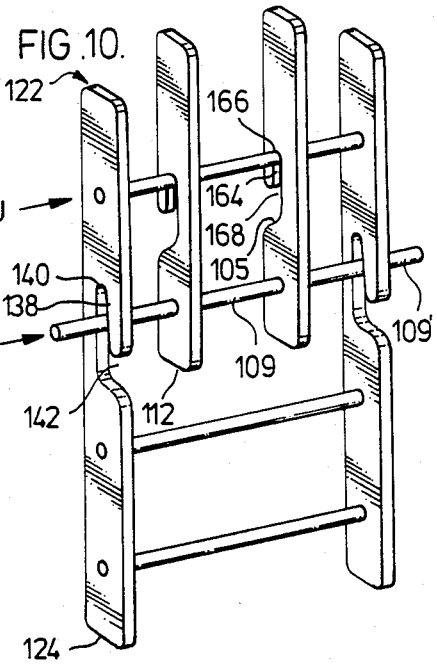

As best seen in FIG. 3, each rail portion 34 is provided with a post 50 which extends transversely outward from the outside surface 48 of rail portion 34. As seen in FIGS. 3, 5 and 6, an internally threaded locking member 56 is provided co-axially on post 50, threadably engaging external threads on the post and with a snap-locking ring 58 preventing withdrawal of the locking member 56 off the outwardmost end of post 50. Locking member 56 has a conical end portion 60 and a handle portion 62 facilitating manual turning of the locking member 56 for a movement axially with respect to post 50 by cooperative engagement of the threaded portion of post 50.

Figure 2:
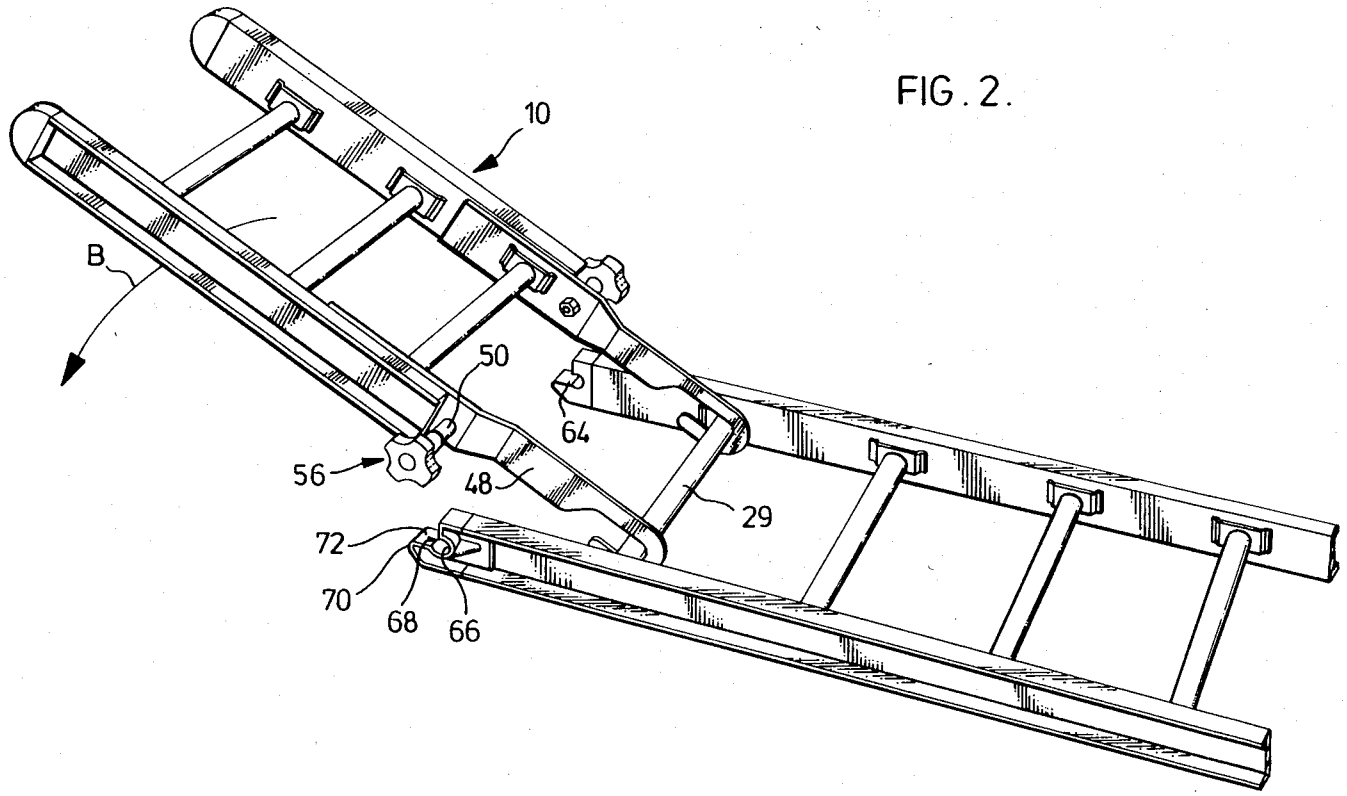
FIGS. 2 and 3 are partial pictorial views of the ladder of FIG. 1 with the two separable ladder sections located relative to each other in second and third positions during a coupling sequence.

Referring now to FIGS. 2 and 3, end cap 30 on the second section 20 at its first end is provided with a secondary slot 64 extending transversely of the rail therethrough in the direction of extension of rungs 28. Secondary slot 64 extends from a blind end 66 longitudinally of rail 26 towards the first end 22 of the second section (and therefore away from the second end 24 of the second section) to slot opening 68 providing an open end to slot 64.

The end cap extends as a longitudinal extension 70 on one side of slot opening 68 longitudinally farther from second end 24 than on the other side of slot opening 68 for the purpose of acting as a stop means in a manner to be described later.

With the major elements of the first and second sections now defined, the interaction of these elements will now be described with reference to FIGS. 1 to 4 which show successive steps in a sequence of coupling the first section to the second section. For the purpose of illustration, the second section 20 is assumed to stay in one position and the first section 10 is to be moved with respect to the second section 20.

The first section 10 is first moved so that both primary slots 42 will receive rung 29. As shown in FIG. 1, first section 10 is preferably positioned so that surfaces 44 proximate slot opening 42 contact rail 29 of the second member, and then by sliding first section 10 in the direction of arrow A shown in FIG. 1, surface 44 may effectively act as a cam surface to guide rung 29 into slot opening 42. Further sliding in the direction of arrow A permits rung 29 to slide from slot opening 42 through the slot until further relative sliding of the first and second portions is prevented by rung 29 engaging blind ends 40 of primary slot 38 and locating these sections in their relative positions shown in FIG. 2.

With the first and second sections in the position shown in FIG. 2, and with rung 29 maintained in engagement with blind slot 40, the first section may be rotated with respect to the second section about rung 29 in the direction indicated by arrow B until posts 50 engage extensions 70 on the first end 22 of the second section preventing further rotation and resulting in the first and second sections being located in their relative positions shown in FIG. 3. With the locking member 56 being withdrawn towards the outermost end of post 50 as seen in FIG. 5, the upper surface 72 of extension 70 of the second section contacts post 50 to stop rotation at the position shown in FIG. 3.

With the first and second sections in the position shown in FIG. 3, the post 50 is in engagement with extension 70 and post 50 is in a position in alignment for coupling with secondary slot 64 by sliding longitudinally in the direction of arrow C until the first and second sections assume their relative positions shown in FIG. 4. In sliding the first section in the direction of arrow C, post 50 slides longitudinally along the upper surface 72 of extension 70 to enter slot opening 68 and slide along secondary slot 64 until the post engages blind end 66. Concurrently with this sliding, the relative position of rung 29 will be changed with respect to primary slot 38 so as to change from the position shown in FIG. 3 with rung 29 engaging blind end 40 by relative sliding of rung 29 in primary slot 38 away from blind end 40, to a position as shown in FIG. 4, with rung 29 disposed in primary slot 38 at an intermediate location between blind end 40 and slot opening 42.

The longitudinal extent of primary slot 38 is chosen so as to be greater than the longitudinal extent of secondary slot 64 so that when the posts 50 engage blind ends 66 preventing further relative sliding of the first and second sections in direction C, rung 29 will remain disposed within primary slot 38. As is to be appreciated, the relative longitudinal positions of rung 29, slot opening 68, blind end 66 and extension 70 on the second section must be chosen having regard to the relative positioning of post 50, and blind end 40 on the first section. For example, as seen in the figures, the longitudinal distance between blind end 66 and the far side of rung 29 on the second section 20 may be equal to the longitudinal distance between post 50 and blind end 40 on the first section 10 less the longitudinal distance from slot opening 68 to blind end 66 on the second section 20.

With the first and second ladder sections engaged as shown in FIG. 4, the extension ladder is satisfactorily assembled for use. Longitudinal compression of the assembled ladder is prevented with post 50 engaging on blind end 66. With post 50 engaging blind end 66 while rung 29 is disposed in primary slot 38, relative rotation of the first section 10 with respect to the second section 20 is prevented. Preferably also, the ouside surfaces 48 of rail portions 34 may closely engage the inside surfaces of rails 26 of second section 20 to provide additional stability.

The preferred embodiment of FIG. 1 also includes an optional locking mechanism whereby locking member 56 may securely lock post 50 to end cap 30 of the second section. As described and best shown in FIGS. 5 and 6, locking member 56 has a truncated conical end portion 60 co-axially located about post 50. End cap 30 carrying secondary slot 64 is formed at blind end 66 to have a conical recess complementary to conical end portion 60. As seen in FIGS. 5 and 6, blind end 66 proximate the inside surfaces of rail 26 has a diameter marginally larger than that of post 50. As the blind end extends transversely towards the outside surfaces 78 of rails 26 it opens into a conical recess 80 having conical walls 82. Conical recess 80 is co-axial with respect to post 50 when post 50 is engaged with blind end 66.

The operation of the locking mechanism is now described. In coupling the first and second sections together as described by the sequence with reference to FIGS. 1 to 4, the locking member 56 should be screwed to be withdrawn to the outermost end of post 50 so that post 50 may engage and cam on extension 70 to slide into secondary slot 64 and to engage blind end 66. With the first and second sections coupled in their relative positions shown in FIG. 4, then the post 50, locking member 56 and end cap 30 will be in the relative position shown in FIG. 5 being a cross-section through FIG. 4 on section line V—V'. The engagement of post 50 with blind slot 66 will axially align post 50 and conical end portion 60 with respect to conical recess 80 of end cap 30. Turning handle portion 62 of locking member 56 will move locking member 56 from the retracted or unlocked position shown in FIG. 5 to the locked position shown in FIG. 6 engaging conical walls 82. As best seen in FIG. 3, the conical walls 82 extend more than 180° about the conical recess whereby with the complementary conical end portion 60 engaged in conical recess 80, the first and second sections are positively locked together.

The first embodiment of this invention provides two sections for an extension ladder which facilitates easy coupling together of the two sections in assembly into a complete extension ladder. For example, a single individual may lay the second ladder section 20 on the ground. The first ladder section 10 may then be manipulated to the position shown in FIG. 1. With the surfaces 44 near slot opening 42 on the first section serving to cam and guide rung 29 into primary slot 38, the initial engagement of rung 29 into slot 38 does not require precise manual control of the two ladder sections. Once rung 29 is engaged in primary slot 38, by further pulling the first section in direction A as shown in FIG. 1, rung 29 is caused to slide down the primary slot to engage blind end 40. Next, simple manual rotation of the first section about rung 29 until rotation is stopped by post 50 engaging extension 70 will place the two sections in two positions to be slid longitudinally for engagement of post 50 in secondary slot 64 and contact with blind end 66 thereof. Finally, locking member 56 may be manually turned to cause the locking member to enter conical recess 80 and securely lock the two sections together. Thus, as described, the particular embodiment shown in FIG. 1, the first section need only be roughly manipulated into place in order to accomplish a positive coupling of the two sections together. Cooperating slots and grooves on the two sections provide for the adequate relative positioning of the sections for coupling once rung 29 has been positioned to enter primary slot 38.

Reference is now made to FIGS. 7 to 10 which show second, third, fourth and fifth embodiments in accordance with the present invention. In each of FIGS. 7 to 10, two ladder sections are shown, a first ladder section 110 and a second ladder section 120. Throughout FIGS. 7 to 10 like numerals are used to refer to similar elements.

In each of FIGS. 7 to 10, the first and second ladder sections are shown coupled together in a position ready for use as an extension ladder. The first and second sections are coupled together at two longitudinally spaced junctures, as shown in FIGS. 7 to 10, an uppermost juncture at U and a lowermost juncture at L. Each juncture comprises a longitudinally extending slot in the rails of one of the sections and a rung or extension of a rung from the other of the sections to be received in that slot.

As in the case of FIG. 1, the first end 112 and 122 of the first and second sections 110 and 120, respectively, are designated as the end of each section which is in overlapping relation with the other ladder section while the second ends 114 and 124 of the first and second sections respectively are the ends remote from the other section.

The lowermost juncture L of each of the embodiments shown in FIGS. 7 to 10 comprise a primary slot 138 provided in one of the first section and the second section. The primary slot has a slot opening 142 and a blind end 140. Each primary slot extends longitudinally away from the blind end 140 in a direction away from the first end 112 or 122 of the first or second section provided with the primary slot. Adapted to be received in the primary slots 138 is a primary rung 109 or lateral extensions thereof on the other of the first and second sections to that on which the primary slot 138 is provided. One of the primary slots 138 and the primary rung 109 is located sufficiently proximate the first end 112 of the first section that with the primary rung 109 received in the primary slot so as to engage blind end 140, the first section 110 is rotatable with respect to the second section 120 about primary rung 109.

The uppermost juncture U of each of the embodiments shown in FIGS. 7 to 10 comprises a secondary slot 164 provided in one of the first section and the second section. The secondary slot has a slot opening 168 and a blind end 166 and extends longitudinally away from the blind end 166 in a direction away from the second end 114 or 124 of the first or second section provided with the secondary slot. Adapted to be received in the secondary slot 164 is a secondary rung 107 or extension 107' thereof on the other of the first and second section to that on which the secondary slot is provided.

The one of the secondary slot 164 and secondary rung 107 provided on each of the first sections 110 is shown to be located on the rails 116 of the first section spaced longitudinally from the elements of the lower juncture L on the remote side of the lower juncture L from the first end 112 of the first section. Similarly, the one of the secondary slot 164 and secondary rung 107 provided on each of the second section 120 is located on the rails 126 of the second section spaced longitudinally from the element of the lower juncture L on the remote side of the lower juncture L from the second end 124 of the second section.

The coupling sequence of each of the embodiments of FIGS. 7 to 10 is substantially the same as that described with respect to the first embodiment. Firstly, the primary rung 109 is engaged in primary slot 138 and the sections are moved longitudinally with respect to each other so that primary rungs 109 engages the blind end 140 of the primary slot. Secondly, the first section is then rotated about primary rung 109 until rotation is stopped by secondary rung 107 contacting stopping surfaces designated generally as 105 proximate the slot opening 168 of secondary slot 164. Rotation is stopped in a position in which rung 107 is in alignment to enter secondary slot 164 by substantially longitudinal sliding of the two sections. Thirdly, the first section is slid substantially longitudinally with respect to the second section in a direction to move the primary rung 109 away from engagement with blind end 140 whereby secondary rung 107 enters secondary slot 164 and becomes in engagement with blind end 166 thereof preventing further longitudinal sliding of the first section with respect to the second section in that direction. As may be seen in each of FIGS. 7 to 10, with the secondary rung 107 engaging blind end 166 of the secondary slot, the primary rung 109 remains within primary slot 138 so as to prevent relative rotation of the first section 110 with respect to the second section 120.

In discussing the embodiments of FIGS. 7 to 10, the terms upper and lower junctures have been used. It is to be appreciated however that each of the embodiments illustrated may be used in an inverted position from their orientations shown in the figures. Further, in each of FIGS. 7, 8 and 10, the rails 126 of the second section 120 have been shown to be spaced wider than the rails 116 of the first section 110. By the use of suitable rung projections on any of rungs 107 and 109, the rails of the first section may be provided in modified embodiments to be spaced wider than the rails 126 of the second section. Similar changes could be made regarding the embodiment of FIG. 9. For the purpose of clear illustration, the embodiments of FIGS. 7 to 10 has been shown schematically and preferably the inside surfaces of one set of the rails would closely engage the outside surfaces of the other set of the rails to provide additional stability.

Figure 11:
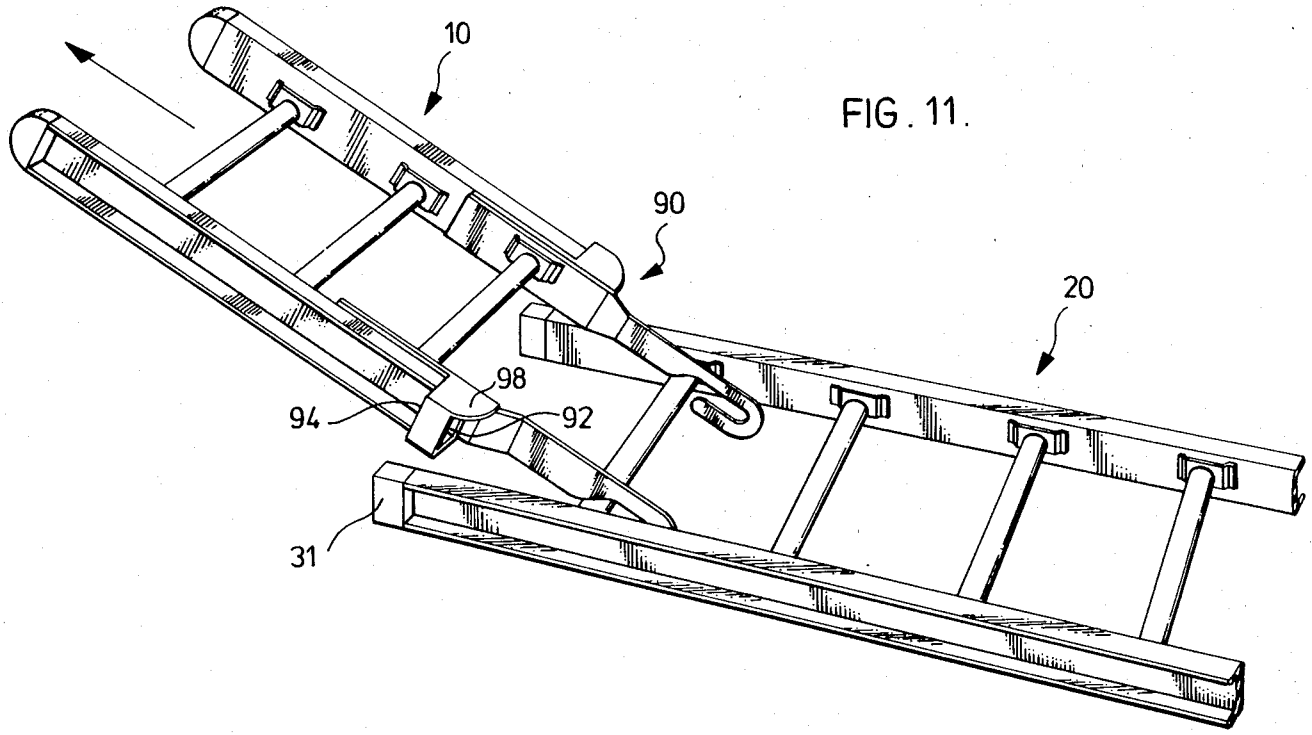
FIG. 11 shows a pictorial view of an extension ladder in accordance with a sixth embodiment of the invention in a position similar to that shown in FIG. 1.

Reference is now made to FIG. 11 which shows a sixth embodiment in accordance with the present invention. The embodiment of FIG. 11 is similar in many respects to that of FIG. 1 and like numerals are used to refer to similar elements. The second section 20 of FIG. 11 differs from the second section of FIG. 1 only in the elimination of end cap 30 as shown in FIG. 1 leaving a simple squared end cap 31 on the first end 22 of the second section 20 of FIG. 11. The first section 10 of FIG. 11 is identical to the first section of FIG. 1 with the exception that post 50 has been replaced by a socket means generally designated 90. The socket means 90 comprises a slot-like socket recess 92 sized to permit entry therein of square end cap 31. The socket recess 92 has a blind end provided by end plate 94 and an open end. Near the open end, a stop plate 98 is provided.

The sequence of coupling the embodiment of FIG. 11 is substantially the same as that for FIG. 1. With rung 29 engaging the blind end 40 of primary slot 38, the first section 10 may be rotated about rung 29 until stop plate 98 contacts end cap 31 stopping rotation at a position in which end cap 31 is in alignment for sliding into socket recess 92. The first section is then slid longitudinally with respect to the second section with end cap 31 to slide into socket recess 92 until end cap 31 contacts end plate 94 preventing further longitudinal movement.

Only the first embodiment shown in FIGS. 1 to 4 has been illustrated with a locking mechanism. While the locking mechanism of the first embodiment is preferably, many other locking mechanisms may be used. For example, in the embodiment of FIG. 11, complementary transversely extending holes could be provided through socket means 90 and end cap 31 so that in a coupled position a pin or bolt could be inserted therein to lock the sections together. Further, the pin could be permanently mounted on the socket means 90 and be biased to a locking position by means of a spring, possibly with a cam-like ramp being provided on end cap 31 to permit automatic movement of the biased pin into the hole in the end cap 31 on end cap 31 being slid longitudinally into socket means 90.

Preferably, the ladder sections as shown in all the embodiments of this application may be constructed from fiberglass or fiber reinforced resin. Many other materials are suitable for example wood and aluminum. Suitable frictional engaging means may be provided on the ends of the ladder section to provide frictional engagement with surfaces to be contacted, for example the ground and the side of a building to assist in preventing a ladder from sliding in use. For example, if end cap 30 comprises fiberglass a rigid rubber pad may be attached to the undersurface of extension 70. Possibly this underpad may extend laterally beyond each rail 26 internally thereof to provide increased contact surface and in which case in some embodiments the rubber pad may double as stop means to contact rails 16 and stop rotation thereof at a position for coupling.

Although the disclosure describes and illustrates preferred embodiments of the invention, it is to be understood that the invention is not limited to these particular embodiments. Many variations and modifications will now occur to those skilled in the art. For a definition of the invention reference is made to the appended claims.

What I claim is:

1. A ladder comprising two separable sections, a ladder extension section and a base ladder section to be coupled together in longitudinally overlapping relation to constitute an extension ladder;

each section comprising rails and rungs, portions of each rail of the extension section at the lower end thereof being spaced to be received between rails of the ladder section and having complementary primary slots formed therethrough to slidably receive one rung of said ladder section therein;

each primary slot having a blind end proximate the lower end of the extension section, said primary slots extending from said blind end longitudinally away from the lower end of the extension section to an open end permitting entrance of said one rung therein; wherein with said one rung received in said primary slots at said blind ends, said extension section being rotatable with respect to said ladder section about said one rung;

first coupling means on said extension section spaced longitudinally from said slot on the remote side of the slot from the lower end of the extension section;

second coupling means on said ladder section spaced longitudinally from said one rung on the remote side of said one rung from the lower end of the ladder section;

stop means, on one of said extension section and ladder section, wherein with said one rung received in said slots at said blind ends, on rotation of said extension section about said one rung, said stop means stopping rotation of said extension section about said one rung at a position wherein said first and second coupling means are in alignment for coupling, said first and second coupling means engaging to couple together by sliding the extension section from said position in a substantially longitudinal direction with respect to the ladder section to slide said one rung in the primary slots away from said blind ends, said primary slots being of sufficient longitudinal extension that with said first and second coupling means coupled together said one rung being retained within said primary slot;

the first and second coupling means on coupling preventing further sliding of said extension section in said direction, and with said first and second coupling means coupled together and said one rung retained within said primary slots relative rotation of said extension section with respect to said ladder section is prevented.

2. A ladder as claimed in claim 1 wherein, said first coupling means comprises projections extending laterally from each rail of the extension section, and said second coupling means comprises a secondary slot in each rail of the ladder section to slidably receive one of said projections, each secondary slot having a blind end and extending from said blind end longitudinally toward the upper end of the ladder section to an open end permitting entrance of said projections.

3. A ladder as claimed in claim 1 wherein, said second coupling means comprises a second rung on said ladder section, and said first coupling means comprises complementary secondary slots on said portion of the rails of said extension section to be received between rails of the ladder section, each secondary slot slidably receiving said second rung and having a blind end, said secondary slot extending from said blind end toward the lower end of the extension section to an open end permitting entrance of said second rung therein.

4. A ladder as claimed in claim 1 wherein said first coupling means comprises blind socket means extending from a blind end longitudinally toward the lower end of the extension section to a socket opening, said second coupling means comprising an uppermost end portion of each rail of the ladder section sized to be slidably received in said socket means and to engage said blind end thereof.

5. A ladder as claimed in claim 2 wherein on coupling, said projections entering and sliding longitudinally in said secondary slots to engage said blind ends thereof to prevent further sliding of said extension section in said direction, and the longitudinal extent of said primary slot being greater than the longitudinal extent of said secondary slot whereby on sliding said extension section from said position said one rung will be retained within said primary slot on said projections engaging said blind ends of said secondary slots.

6. A ladder as claimed in claim 3 wherein on coupling said second rung and said secondary slots, said second rung entering and sliding longitudinally in said secondary slots to engage said blind ends thereof to prevent further sliding of said extension section in said direction, and the longitudinal extent of said primary slot being greater than the longitudinal extent of said secondary slot whereby on sliding said extension section from said position, said one rung will be retained within said primary slot on said secondary rung engaging said blind ends of said secondary slots.

7. A ladder as claimed in claim 1 wherein said primary slots are sized to closely receive said one rung while permitting said one rung to enter said opening and to slide from the opening to said blind end.

8. A ladder as claimed in claim 1 wherein said portions of each rail of the extension section to be received between rails of the ladder section being received therebetween with outer lateral surfaces of said portions closely adjacent inner lateral surfaces of rails of the ladder section to provide lateral stability to the extension ladder.

9. A ladder as claimed in claim 1 wherein said stop means on one of said extension section and ladder section engages a stop abuttment means on the other of said extension section and ladder section to stop said rotation at said position.

10. A ladder as claimed in claim 1 wherein said stop means comprises a lateral projection from a rail of one of the extension section and ladder section to contact a rail of the other of the extension section and base section.

11. A ladder as claimed in claim 2 wherein said stop means comprises a stop portion on said ladder section extending longitudinally away from the lower end of the ladder section from the open end of one of said secondary slots, said stop portion of said ladder section contacting one of said projections to stop said rotation at said position.

12. A ladder as claimed in claim 3 wherein said stop means comprising a stop portion on said extension section extending longitudinally toward the lower end of the extension section from the open end of one of said secondary slots, said stop portion of said extension section contacting one of said second rungs to stop said rotation at said position.

13. A ladder as claimed in claim 4 wherein said stop means comprises a lateral projection from a rail of said extension section to contact a rail of said base section, said projection being located longitudinally towards the lower end of the extension section from the socket opening.

14. A ladder as claimed in claim 1 comprising locking means on one of said extension section and said ladder section to engage the other of said extension section and ladder section to lock said extension section against longitudinal movement relative to the ladder section when said first and second coupling means are coupled together and said one rung is received wherein said primary slots.

15. A ladder as claimed in claim 2 comprising locking means on one of said extension section and said ladder section to engage the other of said extension section and ladder section to lock said extension section against longitudinal movement relative to the ladder section when said first and second coupling means are coupled together and said one rung is received wherein said primary slots.

16. A ladder as claimed in claim 3 comprising locking means on one of said extension section and said ladder section to engage the other of said extension section and ladder section to lock said extension section against longitudinal movement relative to the ladder section when said first and second coupling means are coupled together and said one rung is received within said primary slots.

17. A ladder as claimed in claim 4 comprising locking means on one of said extension section and said ladder section to engage the other of said extension and ladder section to lock said extension sections against longitudinal movement relative to the ladder section when said first and second coupling means are coupled together and said one runs is received within said primary slots.

18. A ladder as claimed in claim 15 wherein one of said projections comprises a cylindrical post extending laterally from said extension section, said locking means comprising a locking member movable on said post between as unlocked position and a locked position in which locked position said locking member lockingly engages said ladder section, and means to retain said locking member in said locked position.

19. A ladder as claimed in claim 18 in which said locking member having a contact surface co-axial with respect to said post, one of said secondary slots having a recess complementary to said contact surface disposed co-axially with respect to said post when said post is in engagement with said blind slot of said one of the secondary slots, and said locking member when in said locked position being received within said recess.

20. A ladder as claimed in claim 18 wherein said locking member is threadably received on said post for axial movement on said post by rotation of said locking member.

21. A ladder as claimed in claim 20 wherein said locking member having handle means to facilitate manual rotation of thereof.

22. A ladder as claimed in claim 18 wherein said stop means comprises a stop portion on said ladder section extending longitudinally away from the lower end of the ladder section from the open end of one of said secondary slots, said stop portion of said ladder sections contacting said post to stop said rotation at said position.

23. A ladder as claimed in claim 21 wherein said stop means comprises a stop portion on said ladder section extending longitudinally away from the lower end of the ladder section from the open end of one of said secondary slots, said stop portion of said ladder section contacting said post to stop said rotation at said position.

24. A ladder as claimed in claim 22 wherein said stop portion provides a camming surface which guides said post into said opening of said one of said secondary slots on sliding said extension section in said direction from said position.

25. A ladder as claimed in claim 23 wherein said stop portion provides a camming surface which guides said post into said opening of said one of said secondary slots on sliding said extension section in said direction from said position.

26. A ladder as claimed in claim 1 wherein said extension section is provided with a camming surface bordering the open end of said primary slots to assist in guiding said one rung into said primary slots.

27. A ladder as claimed in claim 24 wherein said extension section is provided with a camming surface bordering the open end of said primary slots to assist in guiding said one rung into said primary slots.

28. A ladder as claimed in claim 25 wherein said extension section is provided with a camming surface bordering the open end of said primary slots to assist in guiding said one rung into said primary slots.

29. A ladder comprising two separable sections, a first section and a second section to be coupled together in longitudinally overlapping relation to constitute an extension ladder with a first end of each section overlapping with the other section and the other, second end of each section to be remote from the respective other section, each section comprising rails and rungs, the first end of the first section coupling to the second section by means of complementary primary slots in the rails of one of said first and second sections to slidably receive one rung of the other of said first and second sections;

said primary slot having a blind end and extending longitudinally away from said blind slot directionally away from said first end of the first or second section provided with the primary slot to an open end permitting entrance of said one rung therein; wherein with said one rung received in said primary slots at said blind ends, said first section being rotatable with respect to said second section about said one rung, first coupling means on said first section spaced longitudinally from the one of said primary slots and said one rung provided on the first section on the remote side thereof from said first end of the first section;

second coupling means on said second section spaced longitudinally from the one of said primary slots and said one rung provided on the second section on the remote side thereof from the second end of the second section, stop means on one of said first section and second section, wherein with said one rung received in said primary slots at said blind ends, on rotation of said first section about said one rung, said stop means stopping rotation of said first section about said one rung at a position wherein said first and second coupling means are in alignment for coupling, said first and second coupling means engaging to couple together by sliding the first section from said position in a substantially longitudinal direction with respect to the second section to slide said one rung in the primary slots away from said blind ends, said primary slots being of sufficient longitudinal extension that with said first and second coupling means coupled together said one rung being retained within said primary slot;

the first and second coupling means on coupling preventing further sliding of said first section in said direction, and with said first and second coupling means coupled together and said one rung retained within said primary slots relative rotation of said first section with respect to said second section being prevented.

30. A ladder comprising two separable sections, a first section and a second section to be coupled together in longitudinally overlapping relation to constitute an extension ladder with a first end of each section overlapping with the other section and the other second end of each section to be spaced from the respective other section;

each section comprising rails and rungs, portions of each rail of the first section, at the first end thereof being spaced to be received between rails of the second section and having complementary primary slots formed therethrough to slidably receive one rung of said second section therein;

each primary slot having a blind end proximate said one end of the first section, said primary slots extending from said blind end longitudinally away from said first end of the first section to an open end permitting entrance of said one rung therein; wherein with said one rung received in said primary slots at said blind ends, said first section being rotatable with respect to said second section about said one rung;

first coupling means on said first section spaced longitudinally from said slots on the remote side of the slots from said first end of the first section;

second coupling means on said second section spaced longitudinally from said one rung on the remote side of said one rung from the second end of the second section, stop means on one of said first section and second section, wherein with said one rung received in said primary slots at said blind ends, on rotation of said first section about said one rung, said stop means stopping rotation of said first section about said one rung at a position wherein said first and second coupling means are in alignment for coupling, said first and second coupling means engaging to couple together by sliding the first section from said position in a substantially longitudinal direction with respect to the second section to slide said one rung in the primary slots away from said blind ends, said primary slots being of sufficient longitudinal extension that with said first and second coupling means coupled together said one rung being retained within said primary slot;

the first and second coupling means on coupling preventing further sliding of said first section in said direction, and with said first and second coupling means coupled together and said one rung retained within said primary slots relative rotation of said first section with respect to said second section being prevented.

* * * * *